US007266210B2

(12) United States Patent
Lam et al.

(10) Patent No.: US 7,266,210 B2
(45) Date of Patent: Sep. 4, 2007

(54) RECESSED SPEAKER BOX AND MOUNT

(75) Inventors: Peter L. Lam, S. Pasadena, CA (US); Mark W. Jones, Long Beach, CA (US); Patrick G. Reardon, Coto de Caza, CA (US); Pablo C. Tobiano, Metro Manilla (PH)

(73) Assignee: Magnadyne Corporation, Compton, CA (US)

( * ) Notice: Subject to any disclaimer, the term of this patent is extended or adjusted under 35 U.S.C. 154(b) by 481 days.

(21) Appl. No.: 10/819,414

(22) Filed: Apr. 7, 2004

(65) Prior Publication Data

US 2005/0226454 A1 Oct. 13, 2005

(51) Int. Cl.
*H04R 25/00* (2006.01)

(52) U.S. Cl. ..... 381/368; 381/87; 381/387

(58) Field of Classification Search ..... 381/386–389, 381/395, 302–306, 86, 87, 333–336, 391, 381/189, 152; 181/149–150, 198, 141, 148, 181/199

See application file for complete search history.

(56) References Cited

U.S. PATENT DOCUMENTS

| | | | | |
|---|---|---|---|---|
| 1,540,229 | A * | 6/1925 | Scharf | 181/172 |
| 4,441,577 | A | 4/1984 | Kurihara | |
| 4,597,470 | A | 7/1986 | Takagi et al. | |
| 4,853,966 | A * | 8/1989 | Skrzycki | 381/395 |
| 4,891,842 | A | 1/1990 | Green | |
| 4,917,212 | A | 4/1990 | Iwaya | |
| 5,088,574 | A * | 2/1992 | Kertesz, III | 181/150 |
| 5,133,428 | A | 7/1992 | Perrson | |
| 5,321,760 | A | 6/1994 | Gray | |
| 5,400,407 | A | 3/1995 | Cassity et al. | |
| 5,574,796 | A | 11/1996 | Keezer | |
| 5,734,732 | A * | 3/1998 | Lemmon | 381/386 |
| 5,960,095 | A | 9/1999 | Chang | |
| 6,101,262 | A | 8/2000 | Haase et al. | |
| 6,343,135 | B1 | 1/2002 | Ellero et al. | |
| 6,356,640 | B1 | 3/2002 | Lin | |
| 6,741,720 | B1 * | 5/2004 | Myatt | 381/386 |
| 2002/0097889 | A1 | 7/2002 | Makino | |
| 2003/0048917 | A1 | 3/2003 | Manrique et al. | |
| 2004/0005073 | A1 | 1/2004 | Liu | |

* cited by examiner

*Primary Examiner*—Huyen Le
(74) *Attorney, Agent, or Firm*—Brooks Kushman P.C.

(57) ABSTRACT

A speaker system including in combination a speaker and surface mounting apparatus is disclosed. The speaker system has an adapter that secures the speaker system to the wall. A speaker box is secured to the adapter and has at least one speaker that is secured to at least one speaker portal wall of the speaker box, or speaker enclosure. A speaker portal wall is disposed in a plane that is oriented at an angle relative to the wall and is disposed outboard of the wall. A surface mounting adapter has a peripheral edge portion and a planar portion extending between the peripheral edge portion and the enclosure structure. Portions of at least four sides of the enclosure structure protrude from the planar portion of the wall. Other portions of at least four sides of the enclosure structure are recessed relative to the planar portion of the wall.

10 Claims, 3 Drawing Sheets

RECESSED SPEAKER BOX AND MOUNT

BACKGROUND OF THE INVENTION

1. Field of the Invention

The present invention relates to a wall or ceiling mount and enclosed speaker box that is partially recessed and angularly oriented relative to the wall or ceiling.

2. Background Art

Audio speakers for broadcast music, recorded music players, and video entertainment systems are provided in a wide variety of types and styles. Audio systems may be designed for use in buildings, vehicles, or outdoor locations. Generally, audio speaker designs for a vehicle are not ideal for use in buildings. Likewise, audio speakers for use in homes, business, or other buildings are not appropriate for use in vehicles. Recreational vehicles such as motor homes, trailers, or boats are normally designed to provide all the comforts and convenience of home, however, speakers designed for use in buildings cannot usually be used in a recreational vehicle because they are not easily, or attractively anchored.

Typically, speakers used in buildings are provided as bookshelf speakers or floor supported cabinet speakers. Recently, bracket mounted cube or surround sound speaker boxes have been developed for mounting small enclosed speakers to a wall by means of a bracket. Brackets hold the speaker enclosure away from the wall to which they are secured. Bracket mounted speakers require space and are not well adapted for use in vehicles.

Speakers designed to be used in vehicles are generally flush mounted in a dashboard top, package shelf behind a seating area, or inside interior panels. Speciality vehicles such as motor homes, trailers and boats generally have speakers that are flush mounted to the wall or ceiling of the speciality vehicle. Flush mounted speakers cannot be aimed in that sound is focused in a direction that is perpendicular to the plane of the wall or ceiling to which the speaker is mounted. Flush mounted speakers are not generally adjustable and must be mounted within the space provided behind an interior wall or ceiling. Flush mounting arrangements impose some limits on acoustic performance. While bracket mounted speakers may be used in speciality vehicles, expensive brackets must be provided that increase the amount of space required and tend to be unattractive.

There is a need for a speaker mounting arrangement that is attractive and minimizes space requirements. There is also a need for a speaker mount that can be directed toward a listening position and that offers excellent acoustic properties that can be provided within enclosed speakers having internal baffling and wave guides. There is also a need for a speaker mounting arrangement that may be suitable for home or vehicle use and that is particularly well suited for use in speciality vehicles. These needs are addressed by applicant's invention as summarized below.

SUMMARY OF THE INVENTION

According to one aspect of the present invention, a speaker system is provided that is adapted to be secured to a wall. As used herein, the term "wall" when referring to the supporting surface to which the speaker system is secured is intended to include upstanding walls or a ceiling of a building or vehicle. The speaker system comprises an adapter that secures the speaker system to the wall and a speaker box that is secured to the adapter. The speaker box has at least one speaker secured to at least one speaker portal wall. The speaker portal wall is disposed in the plane that is oriented at an angle relative to the wall and is also disposed outboard of the wall.

According to another aspect of the present invention, a speaker and surface mounting apparatus combination is provided. A box-shaped enclosure structure having six sides is provided that has at least one side that is a speaker portal side. An audio speaker is secured to the speaker portal and is enclosed with the enclosure structure. A surface mounting adapter having a peripheral edge portion and a wall having a planar portion extending between the peripheral edge portion and the enclosure structure. Portions of at least four sides of the enclosure structure protrude from the planar portion of the wall, and other portions of the at least four sides of the enclosure structure are recessed relative to the planar portion of the wall. The speaker portal side is disposed outboard of the surface mounting adapter.

According to other aspects of the invention as they relate to the speaker and surface mounting apparatus combination or the speaker system described above, the entire side defining the speaker portal may be disposed outboard of the surface mounting adapter. Four or five sides may protrude in whole or in part from the wall. One of the sides defines the speaker portal side. Another side may be a back side that extends from a distal edge of the side defining the speaker portal to the planar portion of the wall. Another side may be a front side that extends parallel to the back side and partially protrudes from the planar portion of the wall to the side defining the speaker portal. A pair of side walls may be provided that extend between the front side, the back side, and the side defining the speaker portal. The back side may extend in the plane that is at an oblique angle relative to the planar portion of the wall while the front side may extend in a plane that is parallel to the back side and at an acute angle relative to the planar portion of the wall.

According to still further aspects of the invention, the planar portion of the wall may extend substantially diagonally across the side wall where the edge defined by the speaker portal wall and the back side is the portion that protrudes to the greatest extent outboard the planar portion of the wall. The surface mounting adapter may further comprise a recessed portion that is recessed relative to the planar portion of the wall. The recessed portion may have a first oblique wall and a second oblique wall that are obliquely oriented relative to the planar portion that partially receives two sides of the enclosure. This mounting adapter may also further comprise a recessed portion that is recessed relative to the planar portion. The recessed portion may have a first triangular wall and a second triangular wall that partially receives two side walls of the enclosure and are oriented perpendicular to the planar portion of the wall. At least a portion of the planar portion of the wall may be pivotally secured relative to the peripheral edge portion to permit the enclosure to be pivoted to directionally orient the speaker portal.

According to other aspects of the invention as they relate to a speaker system that is adapted to be secured to the wall, the speaker portal side may be entirely disposed outboard of the surface mounting adapter. The speaker box may further comprise a speaker portal side, a back side extending from a distal edge of the side defining the speaker portal to the adapter, a front side extending parallel to the back side and partially protruding from the adapter to the speaker portal, and a pair of side walls extending between the front side, the back side, and the side defining the speaker portal. The speaker box may have a back side that extends in a plane that is disposed at an oblique angle relative to the adapter, while the front side may extend in a plane parallel to the back side and oriented at an acute angle relative to the adapter.

These and other aspects of the invention will be better understood in view of the attached drawings and following detailed description of the best modes of practicing the invention.

DETAILED DESCRIPTION OF THE PREFERRED EMBODIMENT(S)

Figure 1:
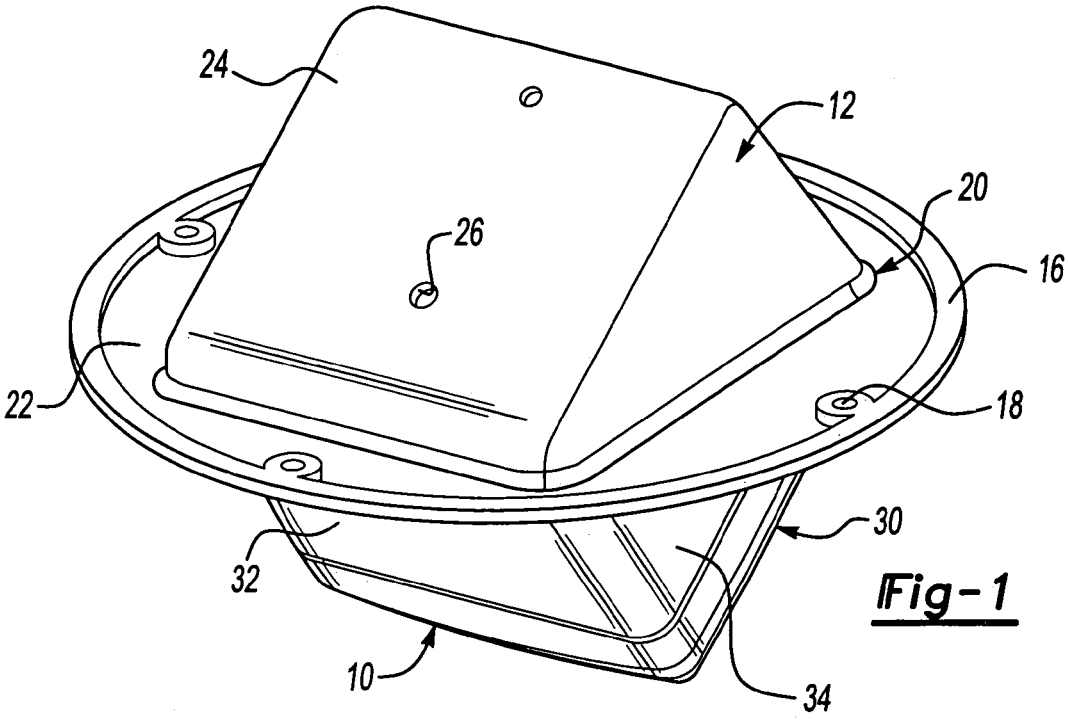
FIG. 1 is a perspective view of a speaker and surface mounting apparatus made according to the present invention.

Referring to FIG. 1, a speaker enclosure 10 is shown in combination with a surface mount apparatus 12. The surface mount apparatus 12 has a peripheral edge 16 that includes fastener bosses 18. A wall 20 extends inboard of the peripheral edge 16. The wall 20 has a planar portion 22 and a recessed portion 24. A plurality of holes 26 are provided in the recessed portion 24 through which fasteners or speaker wires (not shown) may be inserted. Fasteners inserted through the holes 26 may be used to hold the speaker enclosure 10 to the surface mount apparatus 12. Speaker wires provide modulated current to the speaker enclosure 10, as is well known in the art.

The speaker enclosure 10 has a speaker portal side 30, a rear side 32, and a left side 34 that are visible in FIG. 1.

Figure 2:
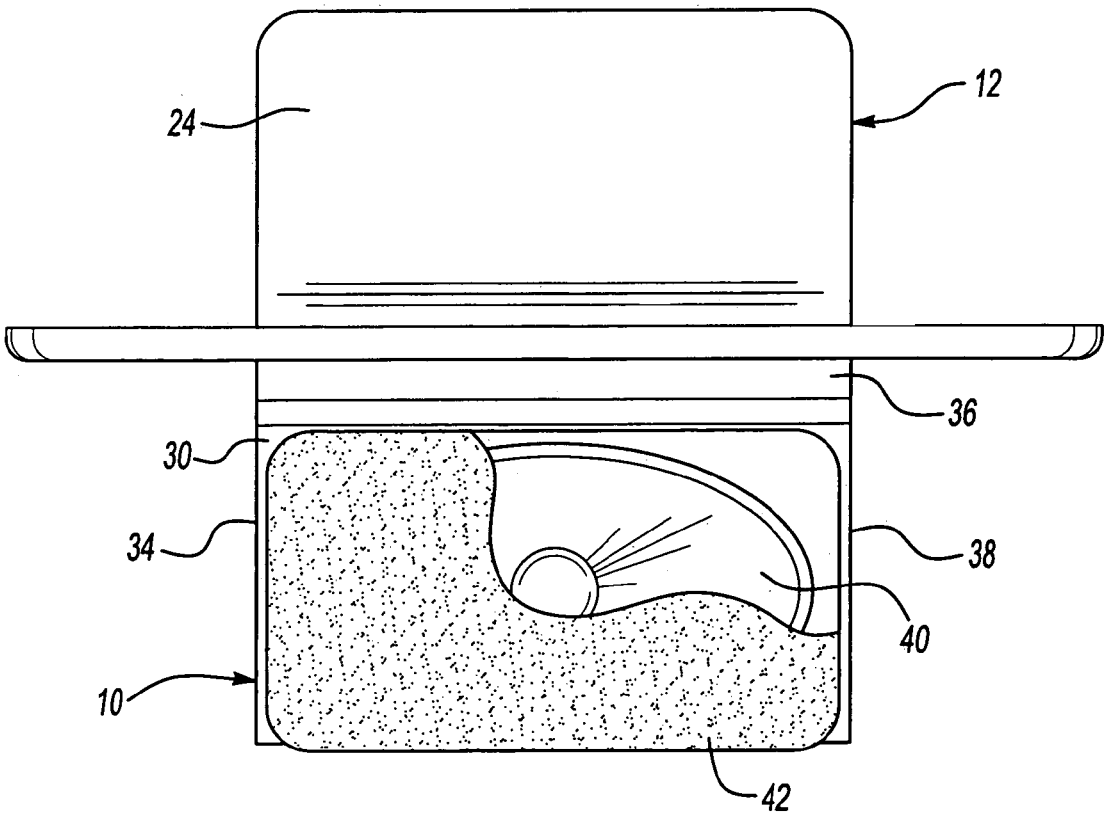
FIG. 2 is a front elevation view thereof.

Referring to FIG. 2, the speaker enclosure 10 is shown in the front elevation view in combination with the surface mount apparatus 12. A front side 36 is shown extending between the surface mount apparatus 12 and the speaker portal side 30. Right side 38 is shown on the opposite side of the speaker enclosure 10 from the left side 34. A speaker 40 is shown in FIG. 2 behind a speaker grill 42. The speaker 40 is secured to the speaker portal side 30.

Figure 3:
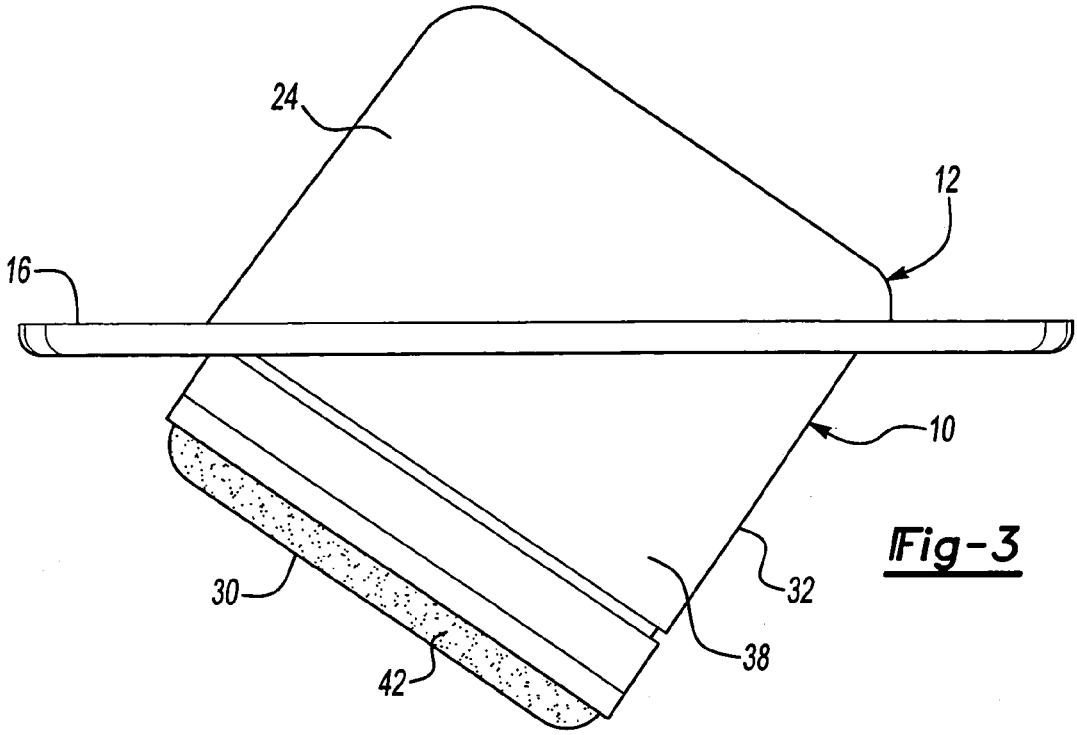
FIG. 3 is a side elevation view thereof.

Referring to FIG. 3, the speaker enclosure 10 is shown received in the surface mount apparatus 12. The surface mount apparatus has a peripheral edge 16 and a recessed portion 24. The speaker portal side 30 is shown in relation to rear side 32 and right side 38 of the speaker enclosure 10. The speaker portal side 30 is shown covered by speaker grill 42.

Figure 4:
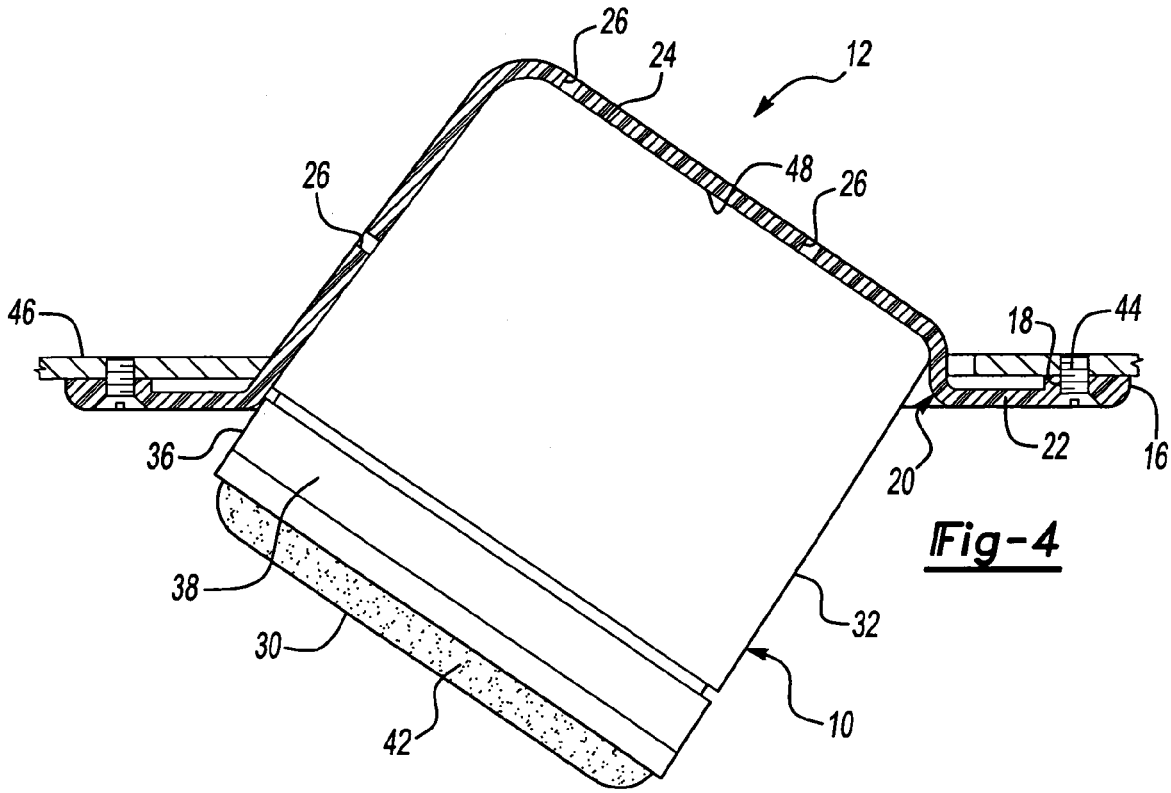
FIG. 4 is a side elevation view partially in cross section thereof.

Referring to FIG. 4, speaker enclosure 10 is shown received in surface mount apparatus 12 as is illustrated in cross section. The surface mount apparatus 12 has a peripheral edge 16 and fastener bosses 18 through which fasteners 48 are inserted to secure the surface mount apparatus 12 to a supporting surface 46, such as a wall or ceiling. A recessed side 48 of the speaker enclosure 10 is secured within the recessed portion 24 of the wall 20.

Figure 5:
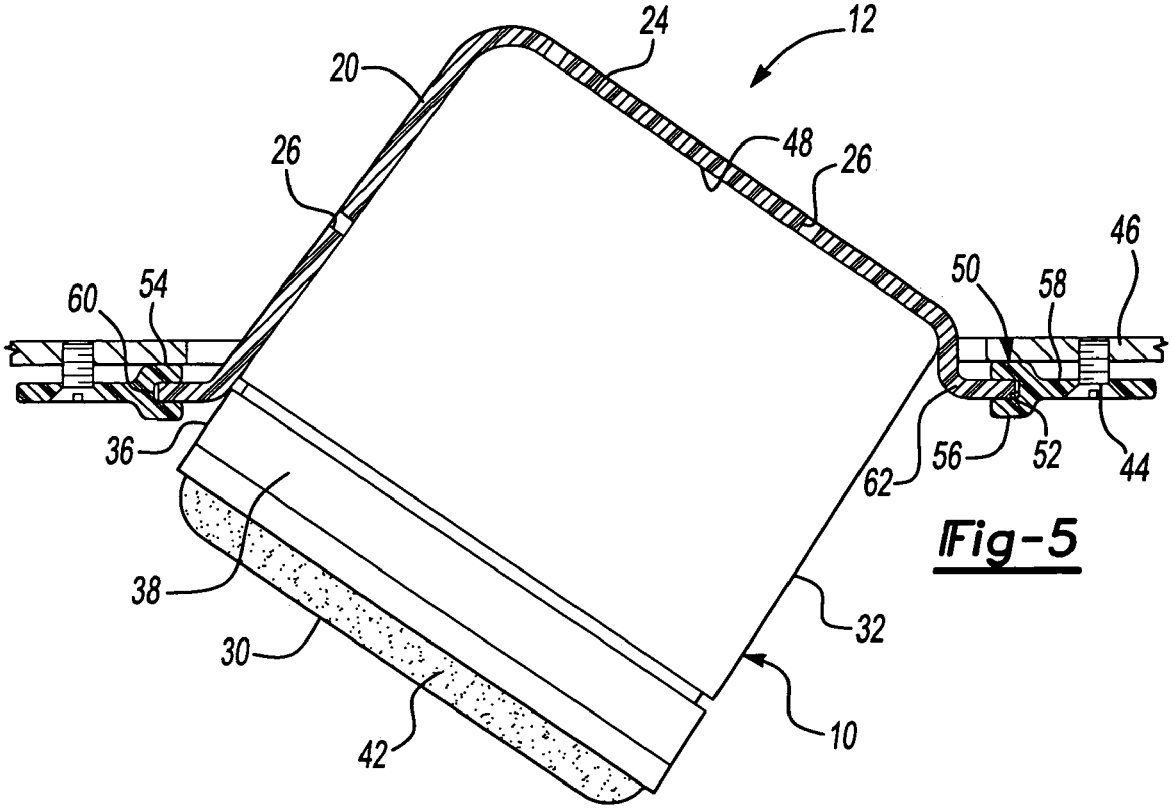
FIG. 5 is a side elevation view partially in cross section of an alternative embodiment of the speaker and surface mount apparatus of the present invention.

Referring to FIG. 5, an alternative surface mount apparatus 12 for the speaker enclosure 10 is shown to include a pivot connection generally indicated by reference numeral 50. The pivot connection 50 may include a groove 52 that is defined by first and second spaced flanges 54 and 56 on a planar rim portion 58. A circular edge 60 of planar portion 62 is received within the groove 52. Reversal of the flange and groove elements are anticipated as well as other pivot connections that are considered to be equivalents. The pivot connection embodiment allows the speaker enclosure 10 to be rotated or pivoted relative to the surface mount apparatus 12. In the pivoting embodiment, the peripheral edge 16 is secured by fasteners 44 that are received in the fastener bosses 48. The recessed side 48 of the speaker enclosure 10 is received within the recessed portion 24.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A speaker system that is adapted to be secured to a wall, comprising:

an adapter that secures the speaker system to the wall in a fixed angular relationship relative to the wall; and a speaker box that is secured to the adapter only in a partially recessed relationship and has at least one speaker secured to at least one speaker portal wall of the speaker box, wherein the speaker portal wall is always oriented in a plane that is disposed at a fixed angle relative to the wall, and wherein the speaker portal wall is also disposed outboard of the wall;

wherein the adapter has a planar portion and a recessed portion that is recessed relative to the planar portion, the recessed portion having a first generally triangular wall and a second generally triangular wall that partially receive two side walls of the speaker box.

2. A speaker system that is adapted to be secured to a wall, comprising:

an adapter that secures the speaker system to the wall in a fixed angular relationship relative to the wall; and an enclosure that is secured to the adapter only in a partially recessed relationship and has at least one speaker secured to at least one speaker portal wall of the enclosure, wherein the speaker portal wall is always oriented in a plane that is disposed at a fixed angle relative to the wall, and wherein the speaker portal wall is also disposed outboard of the wall;

wherein the adapter has a recessed portion and a peripheral edge portion, and further wherein at least a portion of the adapter is pivotally secured relative to the peripheral edge portion to permit the enclosure to be pivoted to directionally orient the speaker portal relative to the wall.

3. A speaker and surface mounting apparatus, in combination, comprising:

a box shaped enclosure structure having six sides, wherein one of the sides is speaker portal side;

an audio speaker is secured to the speaker portal and is enclosed within the enclosure structure;

a surface mounting adapter having a peripheral edge portion and a wall extending between the peripheral edge portion and the enclosure structure, wherein portions of at least four sides of the enclosure structure protrude from the planar portion of the wall at all limes when the enclosure is supported by the adapter, portions of the at least four sides of the enclosure structure are recessed relative to the planar portion of the wall at all times when the enclosure is supported by the adapter; and wherein the speaker portal side is disposed outboard of the surface mounting adapter at all times when the enclosure is supported by the adapter.

4. The combination of claim 3 wherein the entire speaker portal ode is disposed outboard of the surface mounting adapter.

5. The combination of claim 3 wherein the portions of at least four sides that protrude from the wall further comprise:

a back side extending from a distal edge of the side defining the speaker portal to the planar portion of the wall;

a front side exiending parallel to the back side and partially protruding from the planar portion of the wall to the side defining the speaker portal; and a pair of side walls extending between the front side, the back side, and the side defining the speaker portal.

6. The combination of claim 5 wherein the back side extends in a plane that is at an oblique angle relative to the planar portion of the wall, the front side extends in a plane that is parallel to the back side and at an acute angle relative to the planar portion of the wall.

7. The combination of claim 5 wherein the planar portion of the wall extends substantially across the sidewalls, with the edge defined by the side defining the speaker portal and the back side being the portion that protrudes to the greatest extent outboard of the planar portion of the wall.

8. The combination of claim 3 wherein the surface mounting adapter further comprises a recessed portion that is recessed relative to the planar portion of the wall, the recessed portion having a first oblique wall and a second oblique wall that are obliquely oriented relative to the planar portion, and that partially receive two sides of the enclosure.

9. The combination of claim 3 wherein the surface mounting adapter further comprises a recessed portion that is recessed relative to the planar portion, the recessed portion having a first triangular wall and a second triangular wall that partially receive two side walls of the enclosure.

10. The combination of claim 3 wherein at least a portion of the planar portion of the wall is pivotally secured relative to the peripheral edge portion to permit the enclosure to be pivoted to directionally orient the speaker portal.

* * * * *

UNITED STATES PATENT AND TRADEMARK OFFICE

CERTIFICATE OF CORRECTION

PATENT NO. : 7,266,210 B2
APPLICATION NO. : 10/819414
DATED : September 4, 2007
INVENTOR(S) : Peter L. Lam et al.

It is certified that error appears in the above-identified patent and that said Letters Patent is hereby corrected as shown below:

Column 4, Line 62, Claim 3:

Delete “limes” and insert -- times --.

Column 5, Line 5, Claim 4:

Delete “ode” and insert -- side --.

Signed and Sealed this

Twenty-seventh Day of November, 2007

JON W. DUDAS
*Director of the United States Patent and Trademark Office*